US007815432B2

(12) United States Patent
Smith

(10) Patent No.: US 7,815,432 B2
(45) Date of Patent: Oct. 19, 2010

(54) CIGARETTE LIGHTER WITH REPLACEABLE FUEL CARTRIDGE

(76) Inventor: Andrew Smith, 32 Shore Rd., Pascoag, RI (US) 02859

( * ) Notice: Subject to any disclaimer, the term of this patent is extended or adjusted under 35 U.S.C. 154(b) by 0 days.

(21) Appl. No.: 12/020,681

(22) Filed: Jan. 28, 2008

(65) Prior Publication Data

US 2009/0068603 A1 Mar. 12, 2009

Related U.S. Application Data

(63) Continuation-in-part of application No. 11/854,015, filed on Sep. 12, 2007.

(51) Int. Cl.
*F23Q 2/00* (2006.01)

(52) U.S. Cl. ..... 431/143; 431/142; 431/13; 206/459.5

(58) Field of Classification Search ..... 431/13, 431/142, 143, 153; 116/276; 73/327, 330; 206/459.5

See application file for complete search history.

(56) References Cited

U.S. PATENT DOCUMENTS 2,469,507 A * 5/1949 Kolter, Sr. et al. ..... 431/152
2,507,202 A * 5/1950 Finch, Jr. ..... 431/142
2,521,181 A * 9/1950 Morse ..... 431/13
2,539,653 A * 1/1951 Selig ..... 141/110
2,582,028 A 1/1952 Goldman et al.
2,626,517 A 1/1953 Ward
2,633,724 A * 4/1953 Anderson ..... 431/131
2,692,491 A 10/1954 Hepburn
2,692,493 A * 10/1954 Hepburn ..... 431/142
2,710,533 A 6/1955 Fischer et al.
2,727,376 A 12/1955 Felt
2,736,181 A 2/1956 Seibert et al.
2,957,328 A * 10/1960 Gellman ..... 431/130
3,094,245 A 6/1963 Mizuno
3,183,687 A 5/1965 Quercia
5,123,460 A 6/1992 Reed
5,531,591 A 7/1996 Yamazaki
5,934,895 A 8/1999 McDonough et al.
6,093,017 A * 7/2000 Saito et al. ..... 431/153
6,431,853 B1 8/2002 Sher
6,443,727 B1 9/2002 Huang
6,478,575 B2 11/2002 Sher
6,726,470 B1 4/2004 Meister
6,733,277 B2 5/2004 Huang
6,939,128 B2 9/2005 Suzuki et al.
6,945,771 B2 * 9/2005 Xie ..... 431/142
2005/0053883 A1 3/2005 Faber
2005/0070347 A1 3/2005 Ogura (Continued)

*Primary Examiner*—Steven B McAllister
*Assistant Examiner*—Desmond Peyton
(74) *Attorney, Agent, or Firm*—Frank Marino

(57) ABSTRACT

A cigarette lighter has a removable fuel cartridge with a reservoir for holding flammable liquid fuel, a valve for controlling the flow of fuel into and from the reservoir, an ignition actuator for causing ignition of the fuel, a nozzle for causing the ignited fuel to form a lighting flame, and a valve actuator that cooperates with the ignition actuator to open the valve as the ignition actuator is actuated. The reservoir has a transparent portion which is aligned with a window in the lighter housing to allow external observation of the fuel level in the reservoir. The transparent portion includes indicia for gauging the amount of fuel. The indicia is structurally contoured to provide means for engaging the reservoir to remove the fuel cartridge from the lighter.

5 Claims, 3 Drawing Sheets

U.S. PATENT DOCUMENTS

2006/0073432 A1 4/2006 Frigiere
2006/0281038 A1 12/2006 Xu
2007/0160941 A1 7/2007 Lin
2009/0090728 A1* 4/2009 Trude et al. ..... 220/609

* cited by examiner

CIGARETTE LIGHTER WITH REPLACEABLE FUEL CARTRIDGE

RELATED APPLICATION

This application is a continuation-in-part of co-pending U.S. Letters Patent application Ser. No. 11/854,015, the specification and drawings of which are incorporated herein in their entireties by reference.

FIELD OF THE INVENTION

The present invention is related to cigarette lighting apparatuses and the supply of flammable liquid fuel therefore

BACKGROUND

Liquid fuel burning cigarette lighters generally include reservoirs within the lighter housings to contain the fuel and prevent inadvertent leaking. Numerous types of mechanisms and methods are known to release the fuel from the reservoirs in a controlled manner and to ignite the fuel for lighting a cigarette, cigar, or smoking pipe.

There exists a need for improvement in the supply of fuel to liquid fuel burning lighters, and such is an object of the present invention. There exists the need for improvement in the convenience of refueling such lighters, and such is another object of the present invention. There exists the need for improvement in the safety of refueling such lighters, and such is another object of the present invention. There exists the need for improvement in the economy of refueling such lighters, and such is another object of the present invention. There exists the need for improvement in the convenience of gauging the need for refueling such lighters, and such is another object of the present invention. There exists the need for improvement in the efficacy of gauging the need for refueling such lighters, and such is another object of the present invention. And there exists the need to ease the removal of such a fuel cartridge from such a lighter.

U.S. Pat. Nos. 6,939,128, 6,733,277, 6,478,575, 6,443,727, 6,431,853, and 5,531,591 teach mechanisms and means for releasing, lighting, and extinguishing fuel in state-of the art liquid fuel burning lighters. Such mechanisms and means may be adaptable to a lighter of the present invention and are therefore anticipated for use within the present invention, and the specifications of these patents are incorporated herein by reference.

SUMMARY OF THE INVENTION

The invention includes, in combination, a cigarette lighter and a fuel cartridge for use therewith and removable therefrom. The fuel cartridge has a reservoir for containing a flammable liquid fuel, and a valve having a closed state for denying escape of the fuel from the reservoir and an open state for allowing such escape. The lighter has an ignition actuator for causing ignition of the escaped fuel when the ignition actuator is actuated, a nozzle for causing the ignited fuel to form a lighting flame, and a valve actuator cooperating with the ignition actuator to open the valve as the ignition actuator is actuated.

The invention also includes a cigarette lighter having a chamber for receiving a removable fuel cartridge, an ignition actuator for causing, when the ignition actuator is actuated, ignition of fuel escaping from the cartridge, a nozzle for causing the ignited fuel to form a lighting flame, and a valve actuator cooperating with the ignition actuator to cause the escaping of fuel from the cartridge as the ignition actuator is actuated.

The invention further includes a fuel cartridge for use with and removal from a cigarette lighter and having a reservoir for containing a flammable liquid fuel. A valve of the cartridge has a closed state for denying escape of the fuel from the reservoir and an open state for allowing such escape. The cartridge is adapted to cooperate with the cigarette lighter to selectively cause the open and closed states.

The fuel cartridge may be removed from the lighter and replaced, allowing users both economy and convenience, and a choice of the level of each. In alternate embodiments, the fuel cartridge may be removed for refilling then re-inserted. The actuation of a valve within the cartridge by the lighter, only during the lighting process, provides added safety by ensuring fuel leakage prevention.

The invention further includes fuel cartridge forming a reservoir which includes a chamber for holding flammable liquid fuel, with a transparent portion adjacent the chamber. The lighter housing is an opaque shell surrounding the reservoir with a viewing window there-through. The viewing window is aligned with the transparent portion of the reservoir to allow external observation of the amount of fuel within said chamber.

The reservoir may be a container removable from the housing with the fuel sealed therein, and the transparent portion may include indicia for gauging the amount of fuel in the reservoir during the external observation. The indicia may be aligned with the window for gauging the amount of fuel in said reservoir during the external observation, and may be structurally contoured to provide means for engaging the reservoir to force the reservoir from the lighter.

While the term "cigarette" is used throughout this specification and its appended claims, it is anticipated that such a lighter could be used for any similar purpose, such as lighting cigars and smoking pipes. Therefore, the term "cigarettes" is meant to include any such smoking device whenever the term is used in this specification of the appended claims.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 2A:
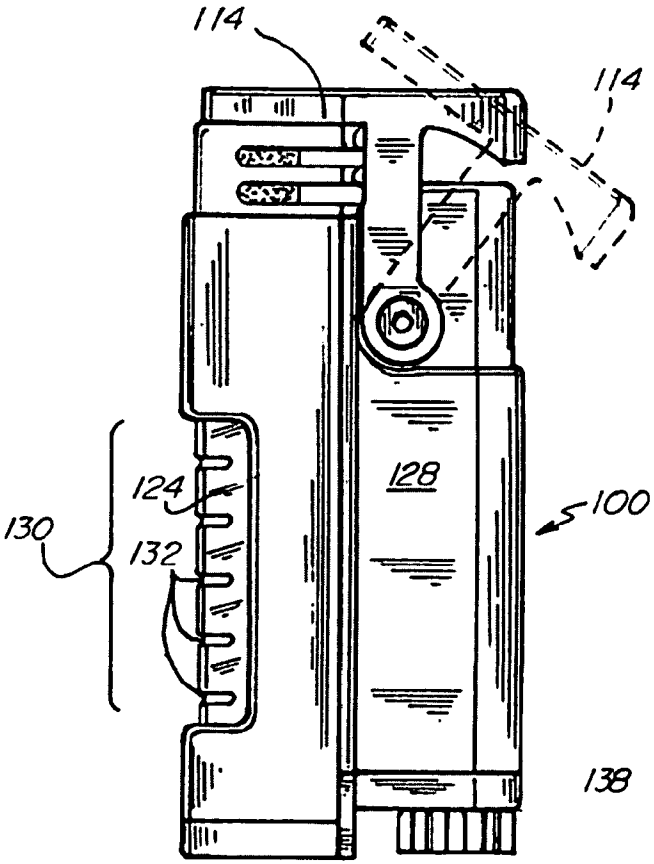
FIG. 2A is a side view of the lighter of FIG. 1.

Reference is now made to FIGS. 1 through 4C, where there is shown a cigarette lighter 100 according to just one of the infinite number of possible embodiments of the present invention.

Lighter 100 includes a housing 126 having an opaque shell 128 which surrounds a hollow interior housing chamber 150 for receiving removable fuel cartridge 102. The cartridge is a reservoir for containing pressurized and flammable liquid fuel 106. The cartridge is captured within housing chamber 150 by bottom cover 136, which is removably affixed to housing 126 by thumbscrew 138.

Lighter 100 also includes a lighting mechanism including ignition actuator 114, piezo activator 144, valve actuator 120, and nozzle 116. The ignition actuator has two functional states; the "closed" state of FIGS. 1 and 4B, and the "open" state of FIG. 4C. Ignition actuator 114 is moved by the user's finger between these open and closed states during lighting and extinguishing, to control the operations of piezo activator 144 and valve actuator 120, as best seen in cross-sectional FIGS. 4B and 4C.

Cartridge 102 includes a valve portion including valve 108 and valve arm 142, which are cooperatively movable between "closed" (FIGS. 1 and 4B), and "open" (FIG. 4C) states, caused by and corresponding to the closed and open states of the ignition actuator.

Cartridge 102 is received within housing chamber 150 with bottom cover 136 removed, then the bottom cover is replaced and secured by thumbscrew 138. Clearing space within housing chamber 150 ensured that valve arm 142 is not moved relative to cartridge 102 during insertion or after insertion and absent activation of ignition activator 114.

Figure 4C:
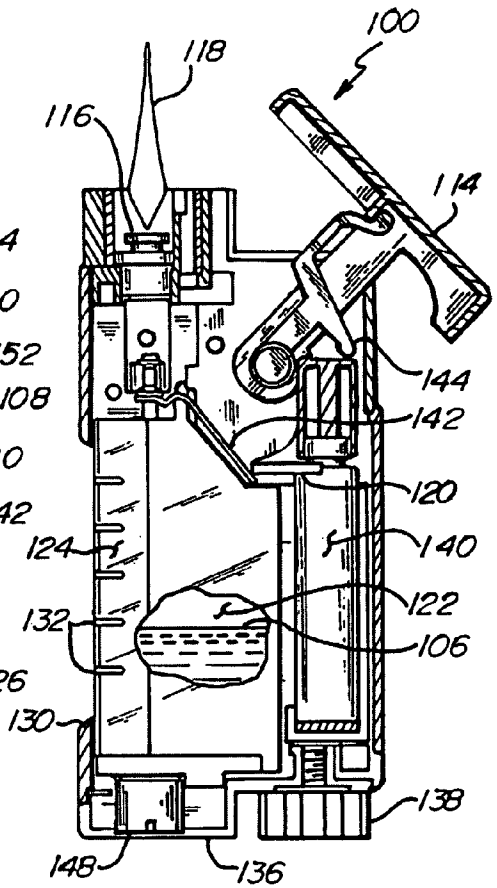
FIG. 4C is a cross-sectional side view of the lighter of FIG. 1 in use.
Figure 4B:
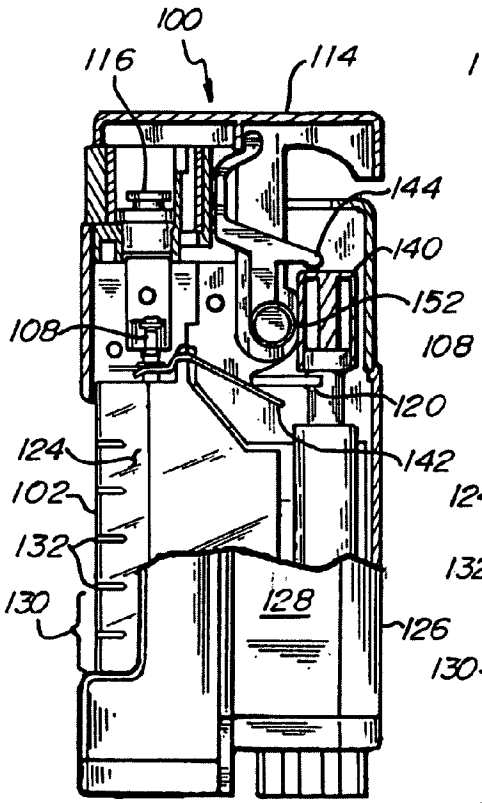
FIG. 4B is a cross-sectional side view of the lighter of FIG. 1 after insertion of its fuel cartridge.
Figure 4A:
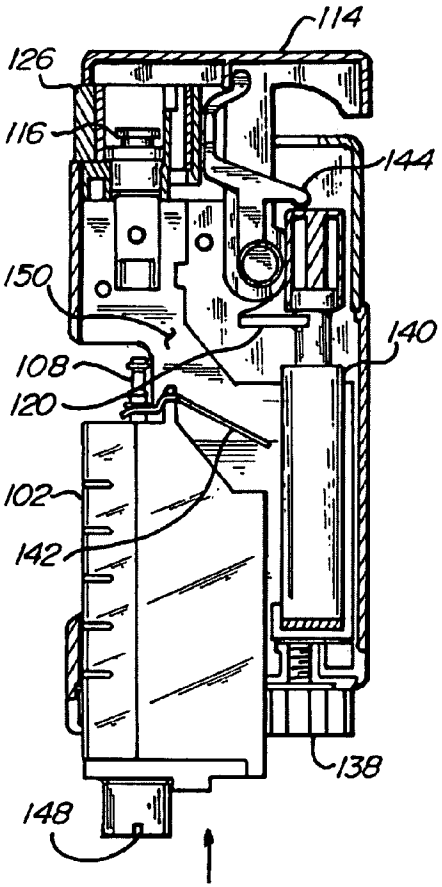
FIG. 4A is a cross-sectional side view of the lighter of FIG. 1 during insertion of its fuel cartridge.

As best appreciated by a comparison of FIGS. 4B and 4C, movement of ignition activator 114 sets into motion several simultaneous events. During movement of the ignition actuator from its closed state of FIGS. 1 and 4B to its pen state of FIG. 4C, valve actuator 120 is pushed downwardly against valve arm 142, causing cartridge valve 108 to open and the pressurized fuel held within the cartridge's fuel chamber 122 to escape through the valve and through lighter nozzle 116. Simultaneously, piezo activator 114 compresses and triggers piezo-electric igniter 140, which is electrically connected to nozzle 116, causing a spark at the nozzle and ignition of the escaping fuel, as represented by lighting flame 118, for lighting a cigarette or such.

The piezo-electric igniter and igniting process may also be in accordance with any of those described in further detail in the previously mentioned U.S. Pat. Nos. 6,939,128, 6,733,277, 6,478,575, 6,443,727, 6,431,853, and 5,531,591.

Figure 1:
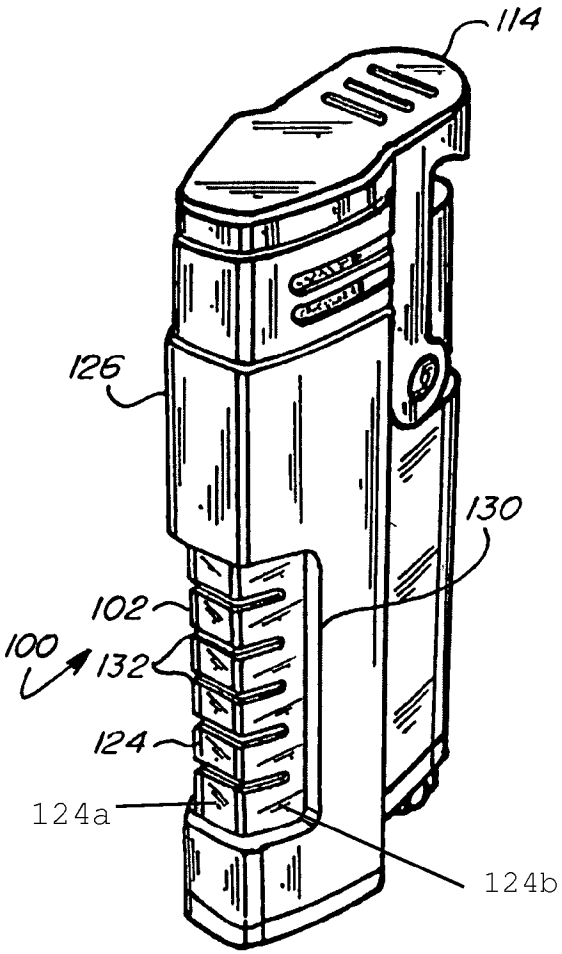
FIG. 1 is a perspective view of a lighter according to an exemplary embodiment of the invention.
Figure 2B:
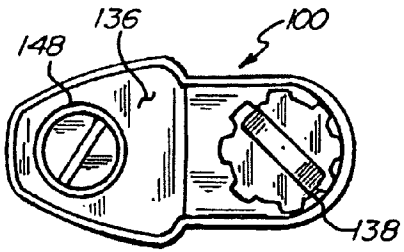
FIG. 2B is a bottom view of the lighter of FIG. 1.
Figure 3B:
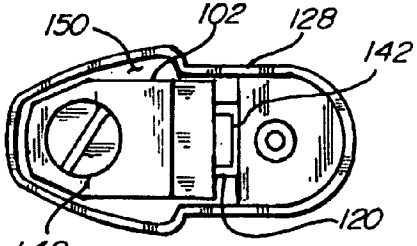
FIG. 3B is a bottom view of the lighter of FIG. 1 with its cartridge cover removed.
Figure 3C:
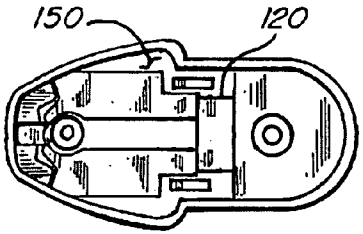
FIG. 3C is a bottom view of the lighter of FIG. 1 with its cartridge cover and fuel cartridge removed.
Figure 3A:
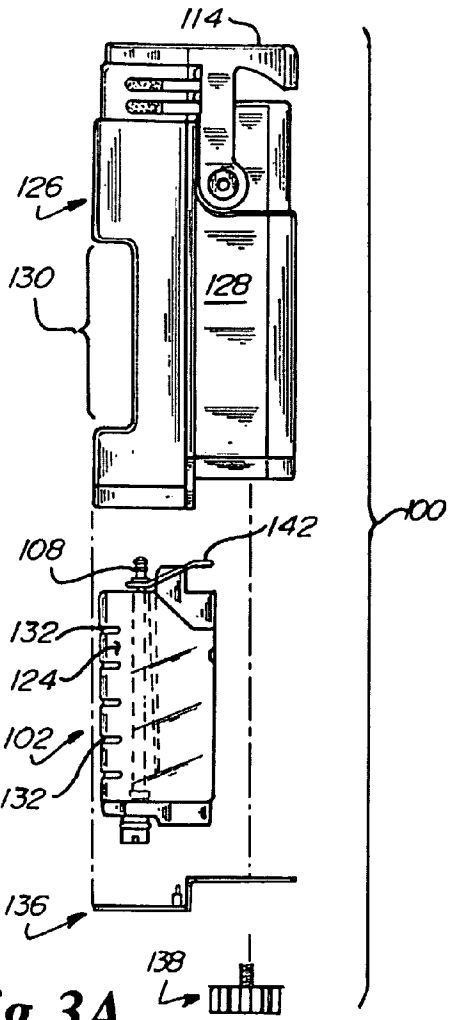
FIG. 3A is an exploded side view of the lighter of FIG. 1.

Release of ignition actuator 114 causes it to return to its closed state of FIGS. 1 and 4B by the bias of torsion spring 152, thereby lifting valve actuator 120. Valve 108 and valve arm 142 are biased to their closed states by a spring (not shown) within fuel chamber 122, so that the lifting of valve actuator 120 allows closing of valve 108 and the extinguishing of lighting flame 118 extension spring.

Lighter 100 and cartridge 102 provide convenient and economical method for replacing depleted fuel, and an advantageous manner for manufacturers to sell pre-filled fuel cartridges at a cost far lower than the cost of replacing an entire lighter. Such an arrangement also provides a safety advantage over refilling the lighter from an external fuel source.

For those users inclined to refuel from an external source, cartridge 102 may include removable refueling port 148, for optionally allowing refueling of the cartridge from an external fuel source, which refueling can be done safety apart from the lighter and it's ignition means by simply removing the cartridge prior to refueling.

Another aspect of lighter 100 and cartridge 102 is the improvement which the combination provides for gauging the need for refueling. The lighter's opaque housing shell 128 includes a viewing window 130 though which the user may see the cartridge 102 when it is within the housing chamber 150. The cartridge is transparent in at least the portion 124 adjacent window 130 so that the user may view through the window 130 and transparent portion 124 to see the amount of fuel 106 remaining within the cartridges fuel chamber 122. Indicia 132 may be molded into, embossed onto, or printed onto the transparent portion 124, or onto an adjacent outside surface of shell 128, to allow observation of the relative amount of fuel remaining.

The indicia 132 of cartridge 102 are horizontal grooves integrally molded into transparent portion 124 and, in addition to serving as fuel level markings for gauging the amount of fuel in the reservoir, also provide contouring for aiding in the engagement of the reservoir by a user's finger during removal of the fuel cartridge from the lighter. After removal of bottom cover 136, the user simply presses his thumb or finger tip through window 130 and against transparent portion 124 and indicia 132, and pushes the cartridge in a downward motion and out of the lighter. The indicia function as treading to increase the friction between the finger tip and the otherwise smooth and slippery surface of the transparent portion.

As shown in FIGS. 1 and 2A, the cartridge 102, and preferably the transparent portion 124 thereof, has a front face 124*a* and at least one side face 124*b* that extends rearwardly from the front face 124*a*. The indicia 132 extends continuously across the front face 124*a* and at least partially across the side face 124*b*.

In summary, the invention may include, in combination and separately, a cigarette lighter 100 and a fuel cartridge 102 for use therewith and removable there-from. The lighter may have a chamber 150 for receiving the removable fuel cartridge. The fuel cartridge may be a reservoir for containing a flammable liquid fuel 106, and may have a valve 108 having a closed state for denying escape of the fuel from the reservoir and an open state for allowing such escape. The cartridge may be adapted to cooperate with the cigarette lighter to selectively cause the open and closed states The lighter may have an ignition actuator 114 for causing ignition of the escaped fuel when the ignition actuator is actuated, a nozzle 116 for causing the ignited fuel to form a lighting flame 118, and a valve actuator 120 cooperating with the ignition actuator to open the valve as the ignition actuator is actuated.

The fuel cartridge may be removed from the lighter and either refilled or replaced, allowing users both economy and convenience, and a choice of the level of each. The actuation of a valve within the cartridge by the lighter, only during the lighting process, may provide added safety by ensuring fuel leakage prevention.

The fuel cartridge may form a reservoir which includes a chamber for holding flammable liquid fuel, with a transparent portion 124 adjacent the chamber. The lighter housing may be an opaque shell 128 surrounding the reservoir with a viewing window 130 there-through. The viewing window may be aligned with the transparent portion of the reservoir to allow external observation of the amount of fuel within said chamber.

The reservoir may be a container removable from the housing with the fuel sealed therein, and the transparent portion may have indicia 132 for gauging the amount of fuel in the reservoir during the external observation. The indicia may be aligned with the window for gauging the amount of fuel in said reservoir during the external observation, and may be structurally contoured to provide means for engaging the reservoir to force the reservoir from the lighter.

The indicia may be horizontal grooves in the reservoir, and may be horizontal grooves in the transparent portion. The reservoir may be molded and the indicia may be horizontal grooves integrally molded in the reservoir. The transparent portion may be molded the indicia may be horizontal grooves integrally molded in the transparent portion.

While the invention has been shown and described with reference to a specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

I claim:

1. In combination, a cigarette lighter and a fuel reservoir for use therewith and removable there-from:

said lighter comprising:

a housing for encasing said fuel reservoir, said fuel reservoir being removable through a bottom of said housing; and a window through said housing for viewing and accessing said fuel reservoir, said window comprising a closed perimeter;

said fuel reservoir comprising:

a transparent portion aligned with said window to allow external observation of fuel within; and indicia aligned with said closed perimeter for gauging the amount of fuel in said fuel reservoir during said external observation; wherein said indicia are structurally contoured to provide means for engaging said reservoir to force said fuel reservoir from said housing;

wherein in an installed position the fuel reservoir has at least two faces exposed in the window, the at least two faces having the indicia and wherein the housing has an inner surface around the closed perimeter of the window; and wherein said indicia comprise horizontal grooves in said at least two faces of said reservoir depressed completely into said reservoir from said at least two faces such that said indicia do not interfere with said inner surface of said housing during removal of said fuel reservoir.

2. The combination of claim 1 wherein said indicia comprise horizontal grooves in said transparent portion of said reservoir.

3. The combination of claim 1 wherein reservoir is a molded and said indicia comprise horizontal grooves integrally molded in said reservoir.

4. The combination of claim 1 wherein said transparent portion is molded and said indicia comprise horizontal grooves integrally molded in said transparent portion.

5. In combination, a cigarette lighter and a fuel reservoir for use therewith and removable there-from, said lighter comprising:

a housing for encasing said fuel reservoir said fuel reservoir being removable through a bottom of said housing; and a window through said housing for viewing and accessing said fuel reservoir, said window comprising a closed perimeter;

said fuel reservoir comprising:

a transparent portion aligned with said window to allow external observation of fuel within; and indicia aligned within said closed perimeter for gauging the amount of fuel in said reservoir during said external observation: wherein said indicia are structurally contoured to provide means for engaging said reservoir to force said reservoir from said housing;

wherein said fuel reservoir and said housing in combination define an interface surface within and adjacent said window along which said fuel reservoir abuts said housing;

wherein in an installed position the fuel reservoir has at least two faces exposed in the window, the at least two faces having the indicia and wherein the housing has an inner surface around the closed perimeter of the window; and wherein the indicia comprise horizontal grooves in said at least two faces of said reservoir depressed completely into said reservoir from said at least two faces such that said indicia do not interfere with said inner surface of said housing during removal of said fuel reservoir.

* * * * *